US010029869B2

(12) United States Patent
Sugiyama

(10) Patent No.: US 10,029,869 B2
(45) Date of Patent: Jul. 24, 2018

(54) SHEET CONVEYANCE APPARATUS AND IMAGE FORMING APPARATUS

(71) Applicant: CANON KABUSHIKI KAISHA, Tokyo (JP)

(72) Inventor: Tadahisa Sugiyama, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/002,240

(22) Filed: Jan. 20, 2016

(65) Prior Publication Data

US 2016/0214816 A1 Jul. 28, 2016

(30) Foreign Application Priority Data

Jan. 22, 2015 (JP) ..... 2015-010363

(51) Int. Cl.
*B65H 7/02* (2006.01)
*B65H 5/06* (2006.01)

(52) U.S. Cl.
CPC ..... *B65H 5/062* (2013.01); *B65H 7/02* (2013.01); *B65H 2402/31* (2013.01); *B65H 2402/5152* (2013.01); *B65H 2404/611* (2013.01); *B65H 2553/612* (2013.01); *B65H 2601/121* (2013.01)

(58) Field of Classification Search
CPC ... B65H 7/02; B65H 7/00; B65H 7/04; B65H 7/06; B65H 7/08; B65H 7/10; B65H 7/12; B65H 7/14; B65H 2553/612
See application file for complete search history.

(56) References Cited

U.S. PATENT DOCUMENTS 3,545,742 A 12/1970 Muller
7,495,922 B2 * 2/2009 Ploeg ..... H01L 23/40 257/718
8,388,247 B2 * 3/2013 Ichikawa ..... B65H 7/02 250/559.12
8,608,153 B2 * 12/2013 Ro ..... B65H 1/266 271/9.11
2013/0161893 A1 6/2013 Ro
(Continued)

FOREIGN PATENT DOCUMENTS

CN 1122752 A 5/1996
CN 1583535 A 2/2005
JP S61-064650 A 4/1986
(Continued)

*Primary Examiner* — Thomas A Morrison
(74) *Attorney, Agent, or Firm* — Canon U.S.A., Inc., IP Division

(57) ABSTRACT

A sheet conveyance apparatus includes a rotation unit including a shaft portion and configured to rotate by being pushed by a sheet conveyed, a sensor configured to generate a signal according to a position of the rotation unit in a rotational direction, a first supporting portion configured to rotatably support the shaft portion, a second supporting portion configured to rotatably support the shaft portion, an elastic portion connected to the shaft portion, and configured to extend in an axial direction of the shaft portion, and be elastically deformable in a direction intersecting with the axial direction of the shaft portion, a regulation portion configured to regulate a movement of the rotation unit supported by the first supporting portion and the second supporting portion in the axial direction of the shaft portion by contacting the elastic portion.

26 Claims, 12 Drawing Sheets

(56) References Cited

U.S. PATENT DOCUMENTS

2015/0360894 A1* 12/2015 Takahashi ..... B65H 7/14
271/227

FOREIGN PATENT DOCUMENTS

| | | | | |
|---|---|---|---|---|
| JP | H04-329753 | A | | 11/1992 |
| JP | 2004-115255 | A | | 4/2004 |
| JP | 2006-164581 | | * | 6/2006 |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus for conveying a sheet and an image forming apparatus including the sheet conveyance apparatus.

Description of the Related Art

Conventionally, a sheet conveyance apparatus, which is applicable to an image forming apparatus, used for conveying sheets has been provided with a sheet detection unit for detecting a position of a conveyed sheet. As the sheet detection unit, there is a type of the sheet detection unit in which the conveyed sheet pushes a detection member to rotate it so that the detection member blocks an optical path of a photo-interrupter.

Japanese Patent Application Laid-Open No. 2004-115255 discusses a configuration in which a rotation shaft of a detection member is rotatably supported between a pair of receiving members. The rotation shaft of the detection member is inserted into each of the opening portions formed with end portions of each of the pair of receiving members, so that the detection member is fixed between the receiving members. Each of the opening portions is set to be narrower than the diameter of the rotation shaft of the detection member to prevent the rotation shaft of the detection member from coming off. When the detection member is attached, the pair of receiving members is elastically deformed to temporarily expand each of the opening portions, and the rotation shaft of the detection member is inserted thorough each of the expanded opening portions.

However, in the configuration discussed in Japanese Patent Application Laid-Open No. 2004-115255, if each opening portion is temporarily expanded to attach the detection member (i.e., rotation member), there may be a following problem. Specifically, when the receiving members are elastically deformed to attach the detection member, the receiving members may be plastically deformed to change the size thereof so as to expand the portion for supporting the rotation shaft. As a result, a gap may be generated between each receiving member and the rotation shaft of the detection member, and the smooth rotation of the detection member cannot be achieved.

SUMMARY OF THE INVENTION

The present invention is directed to a sheet conveyance apparatus and an image forming apparatus capable of achieving smooth rotation of a member pushed and rotated by a sheet.

According to an aspect of the present invention, a sheet conveyance apparatus includes a conveyance unit configured to convey a sheet, a rotation unit including a shaft portion and configured to rotate by being pushed by a sheet conveyed by the conveyance unit, a sensor configured to generate a signal according to a position of the rotation unit in a rotational direction, a first supporting portion configured to rotatably support the shaft portion, a second supporting portion configured to rotatably support the shaft portion, an elastic portion connected to the shaft portion, and configured to extend in an axial direction of the shaft portion, and be elastically deformable in a direction intersecting with the axial direction of the shaft portion, a regulation portion configured to regulate the rotation unit supported by the first supporting portion and the second supporting portion at the shaft portion of the rotation unit from moving in the axial direction of the shaft portion by contacting the elastic portion.

Further features of the present invention will become apparent from the following description of exemplary embodiments with reference to the attached drawings.

DESCRIPTION OF THE EMBODIMENTS

Image Forming Apparatus

Figure 1:
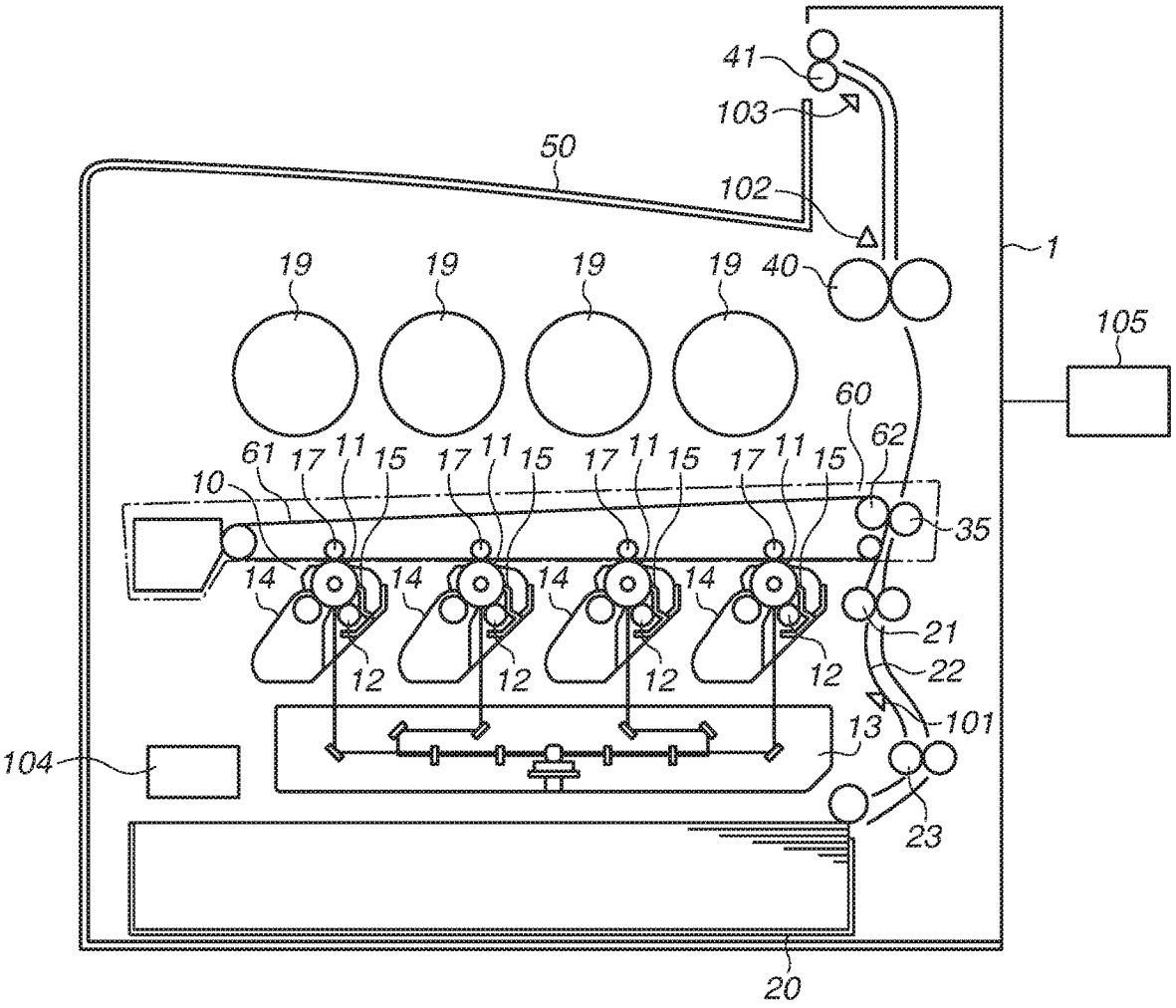
FIG. 1 is a schematic diagram of an image forming apparatus.

FIG. 1 is a schematic diagram illustrating an image forming apparatus including a sheet conveyance apparatus according to an exemplary embodiment of the present invention.

An image forming apparatus 1 includes an image forming station for yellow (Y), an image forming station for magenta (M), an image forming station for cyan (C), and an image forming station for black (Bk). These image forming stations have a similar configuration to each other. Therefore, as long as it is not particularly needed, descriptions of components thereof are made as a singular form. Each image forming station includes a photosensitive drum 11, a charging roller 12, and a developing unit 14.

A surface of the photosensitive drum 11 serving as an image bearing member is uniformly charged by the charging roller 12. Then, a latent image is formed thereon with a laser scanner 13 driven based on a transmitted image information signal. The latent image is visualized as a toner image by the developing unit 14, to which toner is supplied from a container 19 storing toner. Each of the toner images formed on the photosensitive drums 11 is sequentially transferred onto an intermediate transfer belt 61 by a predetermined pressure and an electrostatic load bias applied by a primary transfer roller 17, which is a part of a transfer unit 60. After the transfer of the toner images, a small amount of toner remaining on the photosensitive drum 11 is removed and collected by a photosensitive drum cleaner 15, and then, the photosensitive drum is ready for the next image forming.

On the other hand, sheets are fed from a sheet feed cassette 20 one by one, and conveyed by a pre-registration roller pair 23 serving as a conveyance unit for conveying a sheet. The sheet conveyed by the pre-registration roller pair 23 is guided by a conveyance guide 22, to arrive at a registration roller pair 21. A first sheet detection unit 101 is arranged at a position between the pre-registration roller pair 23 and the registration roller pair 21 to detect a position of a sheet.

The registration roller pair 21, in synchronization with the toner image on the intermediate transfer belt 61, conveys a sheet to between a transfer drive roller 62 for driving the intermediate transfer belt 61 in the transfer unit 60 and an outer secondary transfer roller 35 serving as an outer transfer roller. A color toner image on the intermediate transfer belt 61 is transferred to a sheet at a nip portion formed between the transfer drive roller 62 and the outer secondary transfer roller 35, which are disposed to face each other, by applying a predetermined pressure and an electrostatic load bias to the sheet.

The toner image transferred onto the sheet is fixed thereon by heat and pressure applied by a fixing device (fixing unit) 40. Then, the sheet is discharged by a discharge roller pair 41 onto a discharge tray 50.

Each image forming unit for forming an image on a sheet is configured of the image forming station, the transfer unit 60, and the fixing unit 40.

A second sheet detection unit 102 and a third sheet detection unit 103 for detecting a sheet are respectively arranged on a downstream side of the fixing unit 40 in the sheet conveyance direction, and on an upstream side of the discharge roller pair 41 in the sheet conveyance direction.

Signals output from the first sheet detection unit 101, the second sheet detection unit 102, and the third sheet detection unit 103 are transmitted to a control unit 104 that controls the sheet conveyance. The control unit 104 controls the sheet conveyance based on the signals output from the first, the second, and the third detection units 101, 102, 103. For example, if any one of the first, the second, and the third detection units 101, 102, 103 continues to detect a sheet for a longer time period than a predetermined time period, the control unit 104 determines that the sheet is retained at a position of the corresponding detection unit (retention jam). On the other hand, if no sheet detection unit detects the sheet at a timing at which the sheet is supposed to reach there, the control unit determines that a not-arrived jam occurs. In these cases, the control unit 104 stops the sheet conveyance and displays a warning on an operation unit 105 for prompting a user to remove the jammed sheet.

<Schematic Configuration of Sheet Detection Unit>

Figure 2:
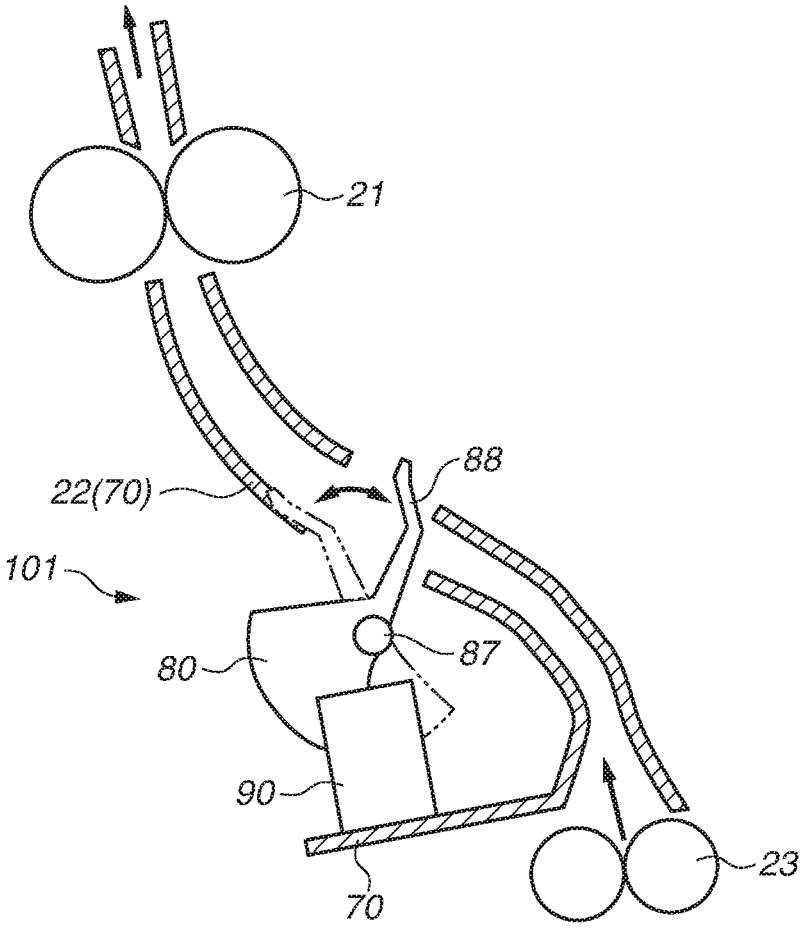
FIG. 2 is a cross sectional view of a sheet detection unit.
Figure 3:
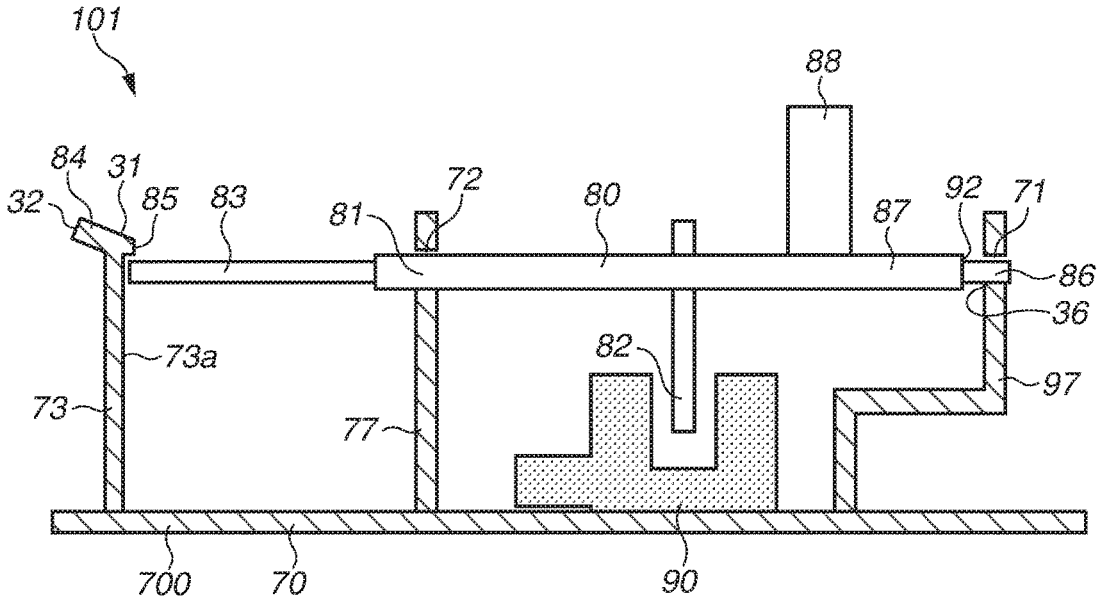
FIG. 3 is a schematic plan view of the sheet detection unit
Figure 4:
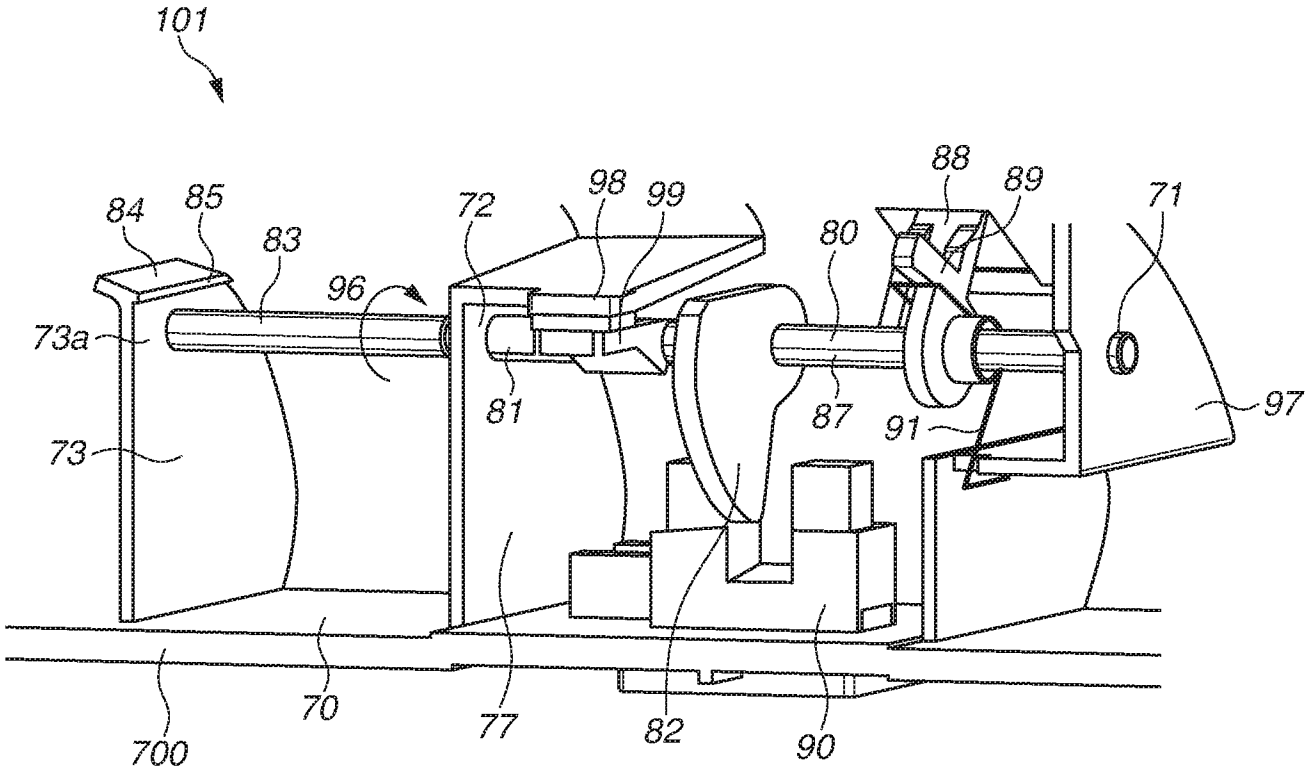
FIG. 4 is a perspective view of the sheet detection unit.

Referring to FIGS. 2 to 4, a configuration of the first sheet detection unit 101 will be described. The second sheet detection unit 102 and the third sheet detection unit 103 have a similar configuration to the first sheet detection unit 101. FIG. 2 is a cross sectional view of the first sheet detection unit 101. FIG. 3 is a schematic plan view of the first sheet detection unit 101. FIG. 4 is a perspective view of the first sheet detection unit 101.

The first sheet detection unit 101 includes a detection member 80, a sensor (photo-interrupter) 90, and a supporting member 70. The detection member 80 is a rotation member to be rotated when pressed by a conveyed sheet. The sensor 90 generates a signal corresponding to a position of the detection member 80 in a rotational direction. The supporting member 70 rotatably supports the detection member 80.

As illustrated in FIG. 3, the detection member 80 includes a rotation shaft 87, a light-shielding portion 82 extending from the rotation shaft 87 toward the sensor 90 in a radial direction of the rotation shaft 87, and a contact portion 88. The contact portion 88 extends from the rotation shaft 87 to be able to protrude into a conveyance path through which a sheet is conveyed. Further, as illustrated in FIG. 4, the detection member 80 is provided with a hook portion 89 for hooking a spring 91 for urging the detection member 80 toward a standby position, and an abutting portion 99 that abuts against a stopper 98 provided on the supporting member 70.

The detection member 80 is urged by a force received from the spring 91 to rotate in an urging direction 96 illustrated in FIG. 4. In addition, the detection member 80 is positioned at the standby position illustrated with a solid line in FIG. 2 and also illustrated in FIG. 4, by the abutting portion 99 of the detection member 80 abutting against the stopper 98. When the detection member 80 is located at the standby position, the contact portion 88 has protruded into the conveyance path.

When the conveyed sheet pushes the contact portion 88, the detection member 80 is rotated in an opposite direction of the urging direction 96 against the urging force of the spring 91. When the detection member 80 is rotated by the pushing of the conveyed sheet, the light-shielding portion 82 blocks the light from a light emitting element in the sensor 90. On receiving a signal from the sensor 90, the control unit 104 detects the presence of a sheet (arrival of a sheet).

<Configuration for Supporting Detection Member>

Next, the configuration for supporting the detection member 80 will be described in detail.

As illustrated in FIGS. 3 and 4, the supporting member 70 that supports the detection member 80 is provided with a first supporting wall portion (first supporting portion) 77 for supporting the rotation shaft 87 of the detection member 80. The first supporting wall portion is formed in a plate-like shape extending from a base portion 700 of the supporting member 70. Further, the supporting member 70 is provided with a second supporting wall portion (second supporting portion) 97 that supports the rotation shaft 87 of the detection member 80.

The plate-like shape first supporting wall portion 77 is provided with a first supporting opening portion 72 as a first opening portion into which the rotation shaft 87 of the detection member 80 is inserted and supported. The second supporting wall portion 97 is provided with a second supporting opening portion 71 as a second opening portion into which the rotation shaft 87 of the detection member 80 is inserted and supported.

The rotation shaft 87 of the detection member 80 includes a large-diameter portion 81, a small-diameter portion 86, and an elastic portion 83 (refer to FIG. 3). The large-diameter portion 81 is a supported portion supported by the first supporting opening portion 72. The small-diameter portion 86 is smaller in diameter than the large-diameter portion 81, and provided at one end portion of the rotation shaft 87. The elastic portion 83 is provided at another end portion of the rotation shaft 87. The elastic portion 83 is provided on an opposite side of the small-diameter portion 86 with respect to the large-diameter portion 81. In other words, the elastic portion 83 is provided on the opposite side of the small-diameter portion 86 across the large-diameter portion 81 in an axial direction of the rotation shaft 87. The elastic portion 83 as a flexible portion has a smaller outer diameter than that of the large-diameter portion 81, so as to bend easily.

The large-diameter portion 81, the small-diameter portion 86, the light-shielding portion 82, and the contact portion 88 of the rotation shaft 87 included in the detection member 80 configure a rotation unit to be rotated by the pushing of a sheet. In the present exemplary embodiment, the elastic portion 83 is directly connected to the shaft portion (large-diameter portion 81 and small-diameter portion 86), supported by the first supporting wall portion 77 and the second supporting wall portion, of the detection member 80. It is easy to deform the elastic portion 83 in an intersecting direction intersecting with the axial direction than the shaft portion (large-diameter portion 81 and small-diameter portion 86). In other word the amount of the deformation of the elastic portion 83 in the intersecting direction per unit length in the state that a force is applied to the elastic portion 83 in the intersecting direction is larger than the amount of the deformation of the shaft portion in the intersecting direction per unit length in the state that the same force is applied to the shaft portion in the intersecting direction.

Figure 5A:
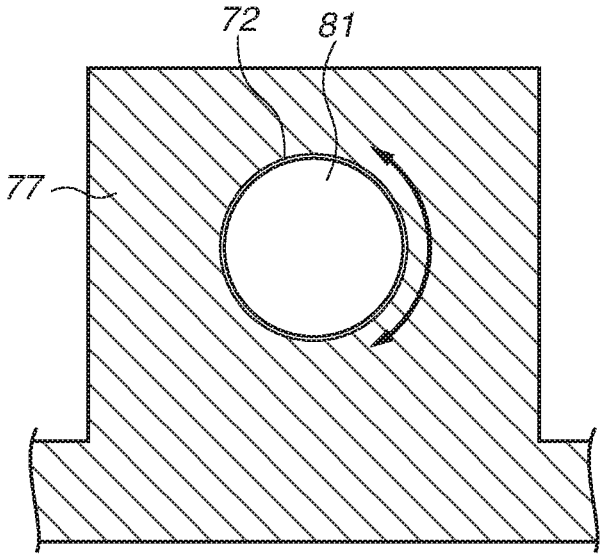
FIGS. 5A and 5B are cross sectional views of the sheet detection unit.
Figure 5B:
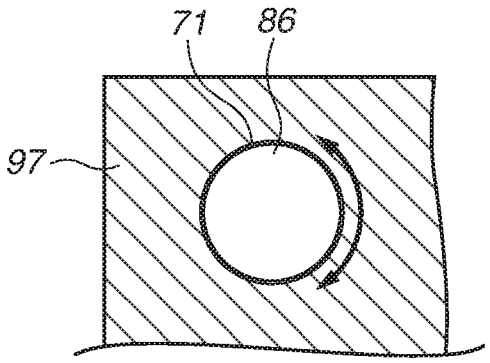

As illustrated in FIGS. 5A and 5B, each of the first supporting opening portion 72 and the second supporting opening portion 71 is configured in a closed circular shape. The first supporting opening portion 72 supports the large-diameter portion 81 (first portion) having a circular cross section larger than that of the elastic portion 83 of the rotation shaft 87 of the detection member 80. The inner diameter of the first supporting opening portion 72 is larger than the outer diameter of the large-diameter portion 81 to a certain extent large enough not to affect the rotational operation of the detection member 80 and small enough not to generate a large bump. The second supporting opening portion 71 supports the small-diameter portion 86 (second portion) of the rotation shaft 87. The inner diameter of the second supporting opening portion 71 is larger than the outer diameter of the small-diameter portion 86 to a certain extent large enough not to affect the rotational operation of the detection member 80 and small enough not to generate a large bump. In the present exemplary embodiment, the difference between the inner diameter of the first supporting opening portion 72 and the outer diameter of the large-diameter portion 81, and the difference between the inner diameter of the second supporting opening portion 71 and the outer diameter of the small-diameter portion 86 are set to be 0.1 mm as a nominal size.

The light-shielding portion 82 and the contact portion 88 of the detection member 80 are provided between the first supporting opening portion 72 and the second supporting opening portion 71 in the axial direction of the detection member 80. With this configuration, the positional accuracy of the position of the light-shielding portion 82 becomes high to reduce unstable detection of the sheet.

The detection member 80 includes the small-diameter portion 86 at one end portion thereof, and the second supporting opening portion 71 supports the small-diameter portion 86. A boundary portion 92 between the large-diameter portion 81 and the small-diameter portion 86 (i.e., step portion between the large-diameter portion 81 and the small-diameter portion 86) is in contact with a side surface 36 of the second supporting wall portion 97 (i.e., second regulation portion) (see FIG. 3). The movement of the detection member 80 in the axial direction is regulated by the side surface 36 of the second supporting wall portion 97 that is in contact with the boundary portion 92. In the present exemplary embodiment, the direction toward the small-diameter portion 86 from the large-diameter portion 81 in the axial direction is referred to as a predetermined direction. The side surface 36 of the second supporting wall portion 97 (second regulation portion) is arranged on the predetermined direction side of the first supporting wall portion 77 to regulate the detection member 80 from moving toward the predetermined direction.

The supporting member 70 is further provided with a regulation wall portion 73 serving as a regulation portion. The regulation wall portion 73 contacts the end portion of the elastic portion 83 (i.e., the end portion of the rotation shaft 87) to regulate the detection member 80 from moving in the rotational axis direction. The regulation wall portion 73 is a plate-like shape portion protruding from the base portion 700 of the supporting member 70, extending to intersect with the axial line of the rotation shaft 87 of the detection member 80. The position of the detection member 80 in the axial direction is regulated by a regulation surface 73*a* of the regulation wall portion 73 contacting the end portion of the elastic portion 83. Herein, in the axial direction, the direction toward the elastic portion 83 from the small-diameter portion 86 is referred to as a first direction. In the axial direction, the direction toward the small-diameter portion 86 from the elastic portion 83 is referred to as a second direction. The regulation surface 73*a* regulates the detection member 80 from moving in the first direction by contacting a portion of the rotation shaft 87 positioned on the first direction side of the large-diameter portion 81 (i.e., the end portion of the elastic portion 83).

The end portion of the regulation wall portion 73 is provided with a taper portion 84 inclining with respect to the regulation surface 73*a*. One end portion 31 of the taper portion 84 is provided at a position further separated from the base portion 700 of the supporting member 70 than the line (i.e., axial line) made by connecting the center of the first supporting opening portion 72 and the center of the second supporting opening portion 71, in a perpendicular direction to the axial line.

The taper portion 84 inclines in such a manner that another end portion 32 is further separated from the base portion 700 of the supporting member 70 than the one end portion 31. In other words, the taper portion 84 inclines in such a manner that with the increasing distance from the first supporting opening portion 72 in the axial direction, the distance between the taper portion 84 and the base portion 700 of the supporting member 70 increases in the radial direction of the rotation shaft from the line made by connecting the centers of the first supporting opening portion 72 and the second supporting opening portion 71. Further, a protruding portion 85 is provided on the regulation wall portion 73. The protruding portion 85 is configured to protrude from the one end portion 31 of the taper portion 84 in a direction perpendicular to the regulation surface 73*a*.

In addition, the supporting member 70 illustrated in FIGS. 2 to 4 also includes the conveyance guide 22 (see FIG. 1).

As described above, each of the first supporting opening portion 72 and the second supporting opening portion 71 is configured in a closed (with no cut portion) circular shape (refer to FIGS. 5A and 5B), the rotation shaft 87 of the detection member 80 is held at the whole circumference thereof. Therefore, even if the detection member 80 receives force from any direction, the detection member 80 does not come off from the supporting member 70. The large-diameter portion 81 and the small-diameter portion 86 rotate in a state of contacting at least the arc portion of the inner periphery of each of the first supporting opening portion 72 and the second supporting opening portion 71 (in the present exemplary embodiment, a part of the circular portion) at any time, independent of the rotation position of the detection member 80. Therefore, the detection member 80 can be rotated smoothly. Further, the rotation noise, (abnormal noise) generated caused by the repetition of contact and separation of the rotation shaft 87 of the detection member 80 and the supporting member 70 when the detection member 80 is rotating, can be reduced.

<Attaching Method of the Detection Member 80>

Figure 6A:
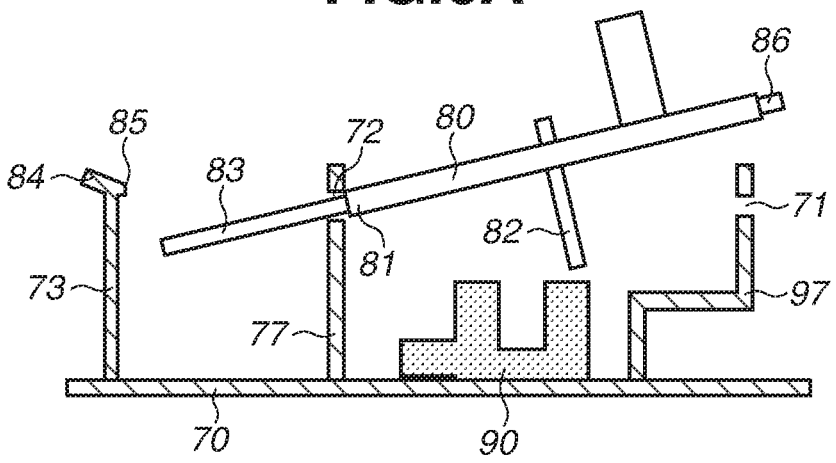
FIGS. 6A, 6B, and 6C are diagrams illustrating how to attach a detection member.
Figure 6B:
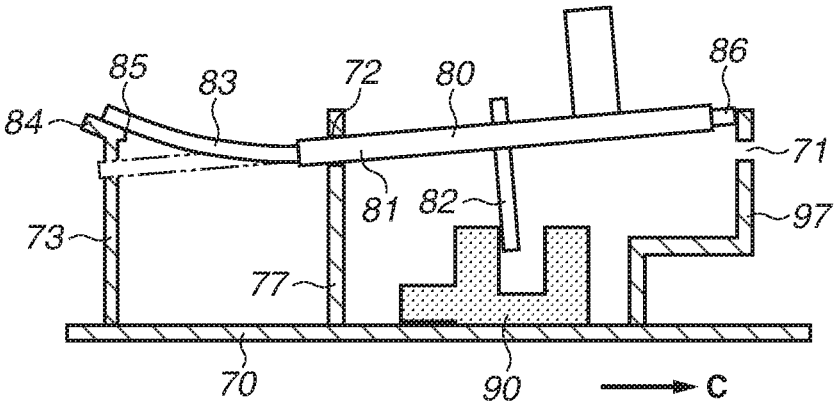
Figure 6C:
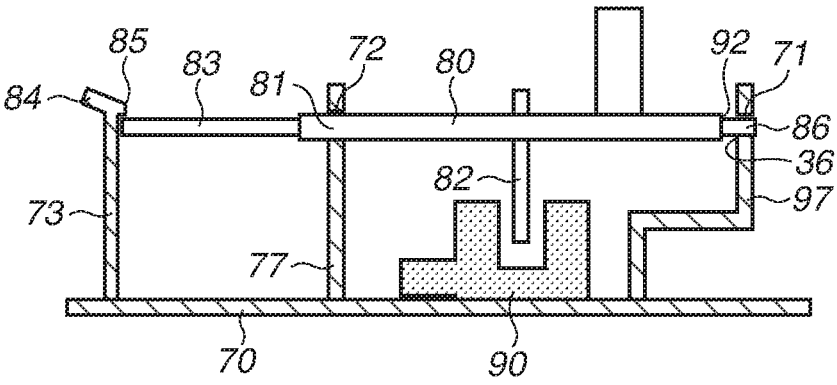

Referring to FIGS. 6A, 6B, and 6C, the attaching method of the detection member 80 will be described. The rotation shaft 87 of the detection member 80 needs to be deformed when the rotation shaft 87 of the detection member 80 is inserted into the first supporting opening portion 72 and the second supporting opening portion 71 (i.e., two openings with no cut portions) to attach the detection member 80 to the supporting member 70. However, if the whole portion of the detection member 80 is deformed, and remains deformed after attachment, the positional relationship between the light-shielding portion 82 of the detection member 80 and the sensor 90 is shifted to reduce the detection accuracy. Therefore, to keep the detection accuracy, it is desirable to deform the detection member 80 at a portion other than the portion between a position supported by the first supporting opening portion 72 and a position supported by the second supporting opening portion 71. Further, to keep the detection accuracy, it is desirable to deform the detection member 80 at a portion far from the light-shielding portion 82. Therefore, in the present exemplary embodiment, as described above, the detection member 80 is provided with the flexible elastic portion 83 protruding long from the large-diameter portion 81 in the rotational axis direction.

To attach the detection member 80 to the supporting member 70, first, as illustrated in FIG. 6A, the elastic portion 83 is inserted into the first supporting opening portion 72 of the supporting member 70. At that time, since the elastic portion 83 is formed smaller than the large-diameter portion 81 in outer diameter, the elastic portion 83 can be inserted easily into the circular first supporting opening portion 72.

Then, as illustrated in FIG. 6B, the detection member 80 is inserted into the first supporting opening portion 72 until the end portion of the detection member 80 reaches the vicinity of the regulation wall portion 73 of the supporting member 70. Then, the end portion of the elastic portion 83 is moved to the taper portion 84 provided at the end portion of the regulation wall portion 73. At that time, the line made by connecting the centers of the first supporting opening portion 72 and the second supporting opening portion 71, and the position of the taper portion 84 is shifted in direction perpendicular to the axial direction. Then, by deforming the elastic portion 83 as illustrated with a solid line, the end portion of the elastic portion 83 of the detection member 80 is positioned at the taper portion 84.

Then, the detection member 80 is moved in the C direction (second direction) illustrated in FIG. 6B, the small-diameter portion 86 (the end portion opposite to the elastic portion 83) of the detection member 80 is inserted into the second supporting opening portion 71, when the elastic portion 83 is released from the taper portion 84. Through this operation, the detection member 80 is attached to the supporting member 70 as illustrated in FIG. 6C. Since the elastic portion 83 is formed to be flexible, the small-diameter portion 86 can be inserted into the second supporting opening portion 71 while the rotation shaft 87 is inserted in the first supporting opening portion 72. Since the elastic portion 83 is smaller than the large-diameter portion 81 in diameter, as illustrated in FIG. 6B, the elastic portion 83 can be bent easily.

The light-shielding portion 82 for blocking light emitted from the light emitting element in the sensor 90 is provided between the first supporting opening portion 72 and the second supporting opening portion 71. Therefore, even if the elastic portion 83 deforms slightly, the deformation rarely affects the detection accuracy of sheet presence/absence.

Since the end portion of the detection member 80 is regulated from moving to the upper side of the taper portion 84 by the protruding portion 85 provided on the one end portion 31 of the taper portion 84, the detection member 80 can be prevented from coming off from the supporting member 70.

In the present exemplary embodiment, the detection member 80 is regulated from moving in the C direction illustrated in FIG. 6C by the side surface 36 of the second supporting wall portion 97 that is in contact with the boundary portion 92 of the small-diameter portion 86 and the large-diameter portion 81. Therefore, although the detection member 80 can be moved slightly in the axial direction within the range of gap, the movement of the detection member 80 in the C direction is restricted by the second supporting wall portion 97. Even if the detection member 80 is pushed in the C direction, the movement of the detection member 80 is regulated at a position at which the end portion located opposite to the small-diameter portion 86 of the detection member 80 can be latched by the protruding portion 85. Therefore, the detection member 80 does not move onto the upper surface side of the taper portion 84 by the end portion opposite to the small-diameter portion 86 of the detection member 80 being unlatched from the protruding portion 85.

Further, if the detection member 80 is pushed in the direction opposite to the C direction, since the movement of the detection member 80 is regulated by the regulation wall portion 73, the small-diameter portion 86 does not come off from the second supporting opening portion 71.

Figure 7A:
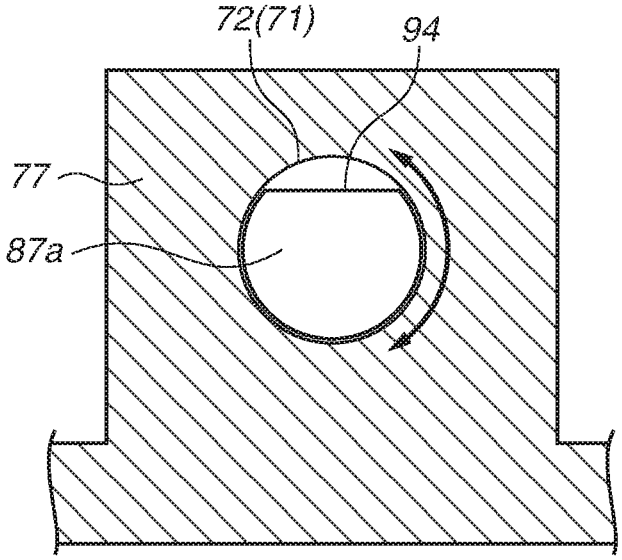
FIGS. 7A and 7B are diagrams illustrating modification examples.
Figure 7B:
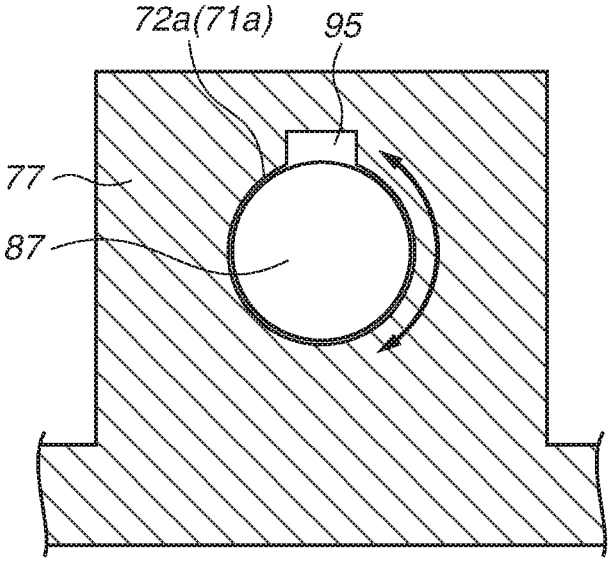

In addition, the exemplary embodiment has been described assuming that the first supporting opening portion 72 and the second supporting opening portion 71 each have a circular shape, and the rotation shaft 87 has a columnar shape. However, as illustrated in FIG. 7A, a rotation shaft 87*a* including a straight portion 94 at a part of the section of the rotation shaft 87 may be used. In addition, as illustrated in FIG. 7B, instead of the first supporting opening portion 72 and the second supporting opening portion 71 each having a circular shape, a first supporting opening portion 72*a* and a second supporting opening portion 71*a* each including a lost part 95 may be used. In other words, it is desirable that the outer circumferential surface of the rotation shaft 87 of the detection member 80 and at least the arc portion of the inner circumferential surface of the supporting opening portion contact each other to support the rotation shaft 87. Although, in FIG. 7B, the lost part 95 cut upward does not reach the upper surface of the first supporting wall portion 77, the lost part 95 may reach the upper surface of the first supporting wall portion 77.

Figure 8:
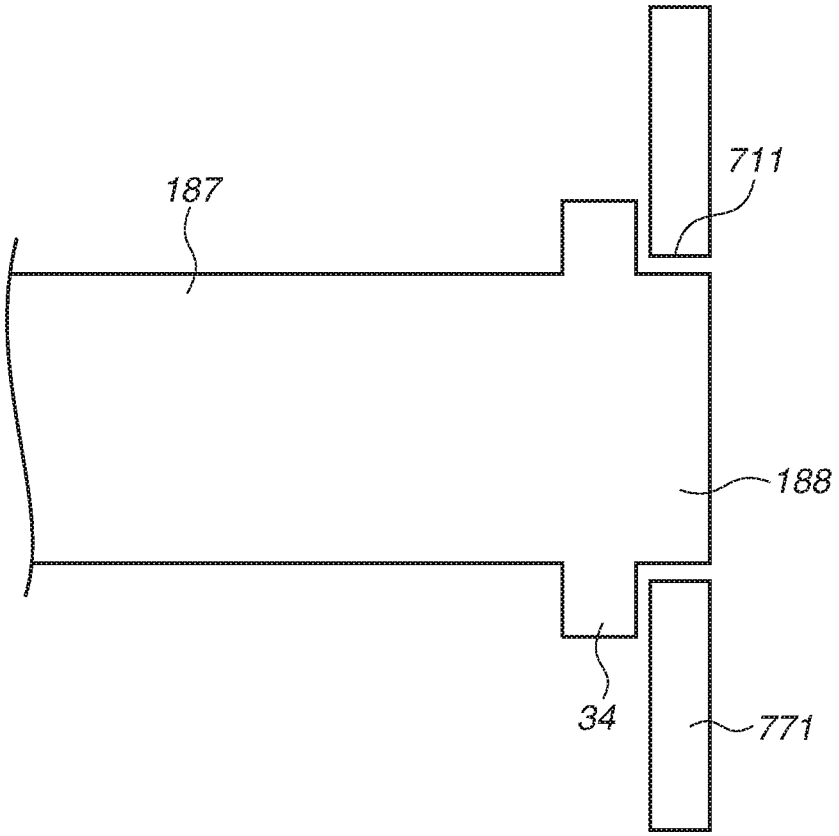
FIG. 8 is a diagram illustrating a modification example.

In the present exemplary embodiment described above, the small-diameter portion 86 is provided at the end portion opposite to the elastic portion 83 of the rotation shaft 87. However, as illustrated in FIG. 8, a flange portion 34 may be provided near an end portion 188 of the rotation shaft 187 of the detection member. Then, the end portion 188 of the rotation shaft 187 is supported by the second supporting opening portion 711 provided through the second supporting wall portion 771. Thus, the flange portion 34 may contact the second supporting wall portion 771 to regulate the movement of the rotation member in the axial direction.

Figure 11:
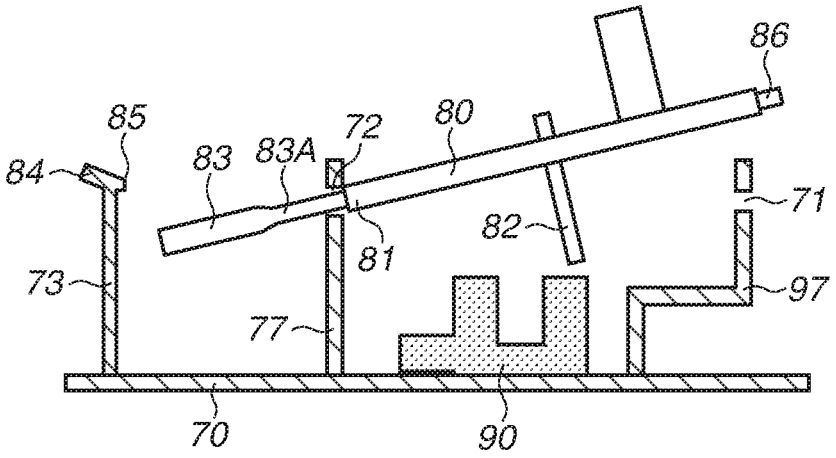
FIG. 11 is a diagram illustrating another configuration of a detection member.

Further, the portion small in diameter extends as the elastic portion 83 to the end of the rotation shaft 87. However, as illustrated in FIG. 11, a portion 83A in the axial direction may be configured to have a small diameter as the elastic portion 83. In this embodiment, the large-diameter portion 81 is also supported by the first supporting opening portion 72 of the first supporting wall portion 77.

Figure 12A:
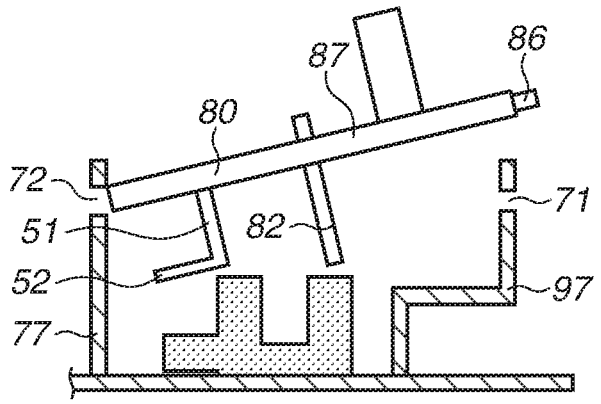
FIGS. 12A, 12B, and 12C are diagrams illustrating another configuration of a detection member.
Figure 12B:
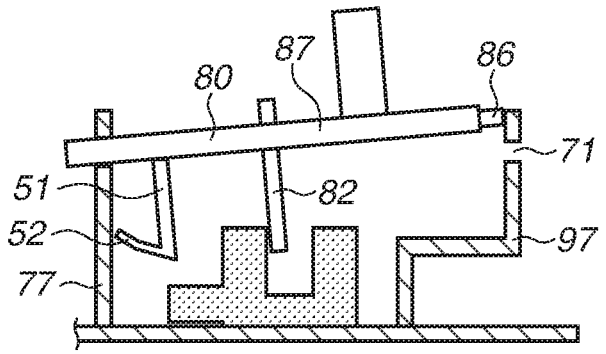
Figure 12C:
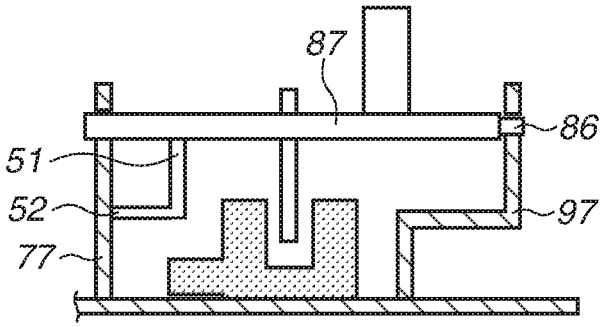

Further, in the present exemplary embodiment described above, the elastic portion 83 extends directly from the shaft supported by the first supporting wall portion 77 and the second supporting wall portion. However, the elastic portion may not directly extend from the shaft portion (not connected directly to the shaft), as long as the elastic portion extends in the axial direction and elastically deformable in the direction intersecting with the axial direction. For example, as illustrated in FIGS. 12A to 12C, a connection portion 51 may extend from the rotation shaft 87 in the radial direction, and an elastic portion 52 may extend from the end of the connection portion 51 in the axial direction. In other words, the elastic portion 52 may be connected with the rotation shaft 87 via the connection portion 51. FIGS. 12A to 12C illustrate the steps of attaching the detection member 80. More specifically, FIG. 12A illustrates a state of inserting the rotation shaft 87 into the first supporting opening portion 72 of the first supporting wall portion 77. FIG. 12B illustrates a state where the elastic portion 52 is deformed in the direction intersecting with the axial direction to insert the small-diameter portion 86 (i.e., the end portion of the rotation shaft 87) into the second supporting opening portion 71, in a state where the rotation shaft 87 is inserted in the first supporting opening portion 72. FIG. 12C illustrates a state where the detection member 80 is attached. As illustrated in FIG. 12C, the end of the elastic portion 52 contacts a part of the second supporting wall portion 77 (regulation portion) to regulate the position of the detection member 80 in the axial direction.

Comparison with Comparative Examples

Figure 9A:
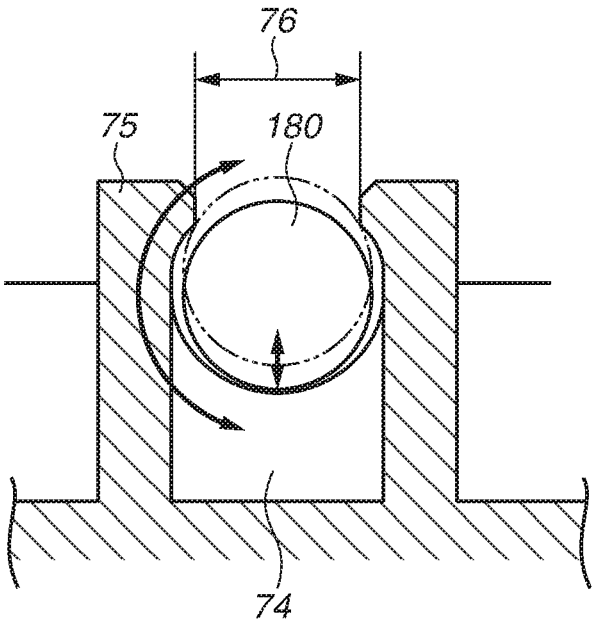
FIGS. 9A and 9B are diagrams illustrating a first comparative example.
Figure 9B:
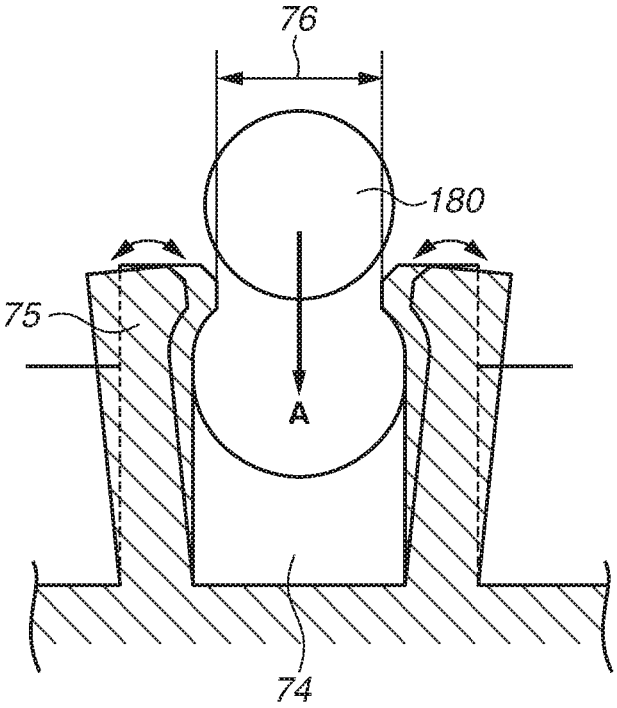

A first comparative example of a supporting method of the detection member will be described with reference to FIGS. 9A and 9B. In the first comparative example, as illustrated in FIG. 9A, a pair of receiving members 75, which forms a shaft bearing portion 74 and an opening portion 76, is provided. At the time of assembling a detection member 180, i.e., when the rotation shaft of the detection member 180 is inserted into the pair of receiving members 75 in the A direction to attach it, the receiving member 75 is elastically deformed to temporarily expand the opening portion 76 (see FIG. 9B). The shaft of the detection member 180 is inserted through the expanded opening portion 76 to attach the detection member 180 to the shaft bearing portion 74. The configuration illustrated in the first comparative example is good in assembling efficiency. In addition, since no retaining member needs not to be added, the cost can be low.

However, with the first comparative example, the detection member 180 may come off from the opening portion 76, when the detection member 180 is pushed in a direction opposite to the A direction. Generally, a portion of the detection member to be pushed by a conveyed sheet protrudes in a conveyance path. Therefore, a user may be able to touch the protruding portion at a time of jam recovery. Accordingly, when the user has touched the detection member, the detection member may come off.

Further, in the first comparative example, since the pair of receiving members 75 is elastically formed. However, when the pair of receiving members 75 is elastically deformed to expand the opening portion 76 to attach the detection member 80 thereto, the pair of receiving members 75 may be plastically deformed to cause a gap between the rotation shaft of the detection member 180 and the receiving members 75 with ease. As a result, as illustrated in FIG. 9A, during the rotation of the detection member 80, the rotation shaft of the detection member 180 keeps moving within the shaft bearing portion 74. As a result, the rotation shaft repeatedly contacts with and separates from the receiving members 75 to cause noise.

In the present exemplary embodiment, the detection member 80 is attached by inserting the rotation shaft 87 of the detection member 80 into the first supporting opening portion 72 and the second supporting opening portion 71 each having no cut portion. Therefore, the chance of the detection member 80 coming off from the first supporting opening portion 72 and the second supporting opening portion 71 is lower than that in the first comparative example. Further, in the present exemplary embodiment, the gap of the rotation shaft 87 of the detection member 80 with respect to the first supporting opening portion 72 and the second supporting opening portion 71 can be reduced. According to the present exemplary embodiment, the detection member can be rotated more smoothly than in the first comparative example in which the receiving members 75 are elastically deformed to expand the opening portion 76. Further, in the present exemplary embodiment, silence during rotation of the rotation shaft 87 can be enhanced. Because, in the present exemplary embodiment, since the detection member 80 is attached by inserting the rotation shaft 87 into the first supporting opening portion 72 and the second supporting opening portion 71, the gap between the rotation shaft and the supporting member, which is generated due to the plastic deformation of the supporting portion in the first comparative example, is not generated.

Figure 10A:
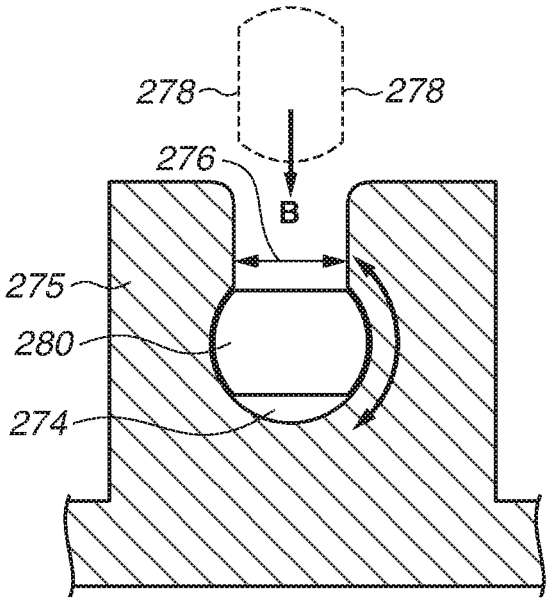
FIGS. 10A and 10B are diagrams illustrating second and third comparative examples.

FIG. 10A illustrates a second comparative example. In the second comparative example, a detection member 280 is supported by two portions (i.e., a shaft bearing portion 274 and a retaining portion 275), and the retaining portion 275 has an opening portion 276 but is not elastically formed. The detection member 280 has a two-way taking shape 278 at a part of the detection member 280 by removing the part of a shaft by the same width as the opening portion 276, and the outer diameter of the shaft other than the two-way taking shape 278 is formed to be wider than the width of the opening portion 276. At a time of assembling, the detection member 80 is moved in the B direction and attached to the shaft bearing portion 274 by adjusting the phase of the two-way taking shape 278 of the rotation shaft of the detection member 280 and the phase of the opening portion 276 of the retaining portion 275. The configuration illustrated in the second comparative example is good in assembling efficiency, like the first comparative example. In addition, since no dedicated retaining member is required, the cost can be low.

However, in the second comparative example, when the phase of the opening portion 276 and the phase of two-way taking shape 278 of the detection member 280 match with each other, the detection member 280 may come off from the retaining portion 275. Therefore, there may be a restriction for a rotation angle of the detection member 280. More specifically, in a case where the detection member 280 rotates more than 90 degrees, the phases of the opening portion 276 and the two-way taking shape 278 match with each other at a point. In this case, there is no removal prevention part, and the detection member 280 may come off from the retaining portion 275.

In the present exemplary embodiment, the detection member 80 is attached by inserting the rotation shaft 87 of the detection member 80 into the first supporting opening portion 72 and the second supporting opening portion 71 each having no cut portion. Therefore, the chance of the detection member 80 coming off from the first supporting opening portion 72 and the second supporting opening portion 71 is lower than that in the second comparative example.

Figure 10B:
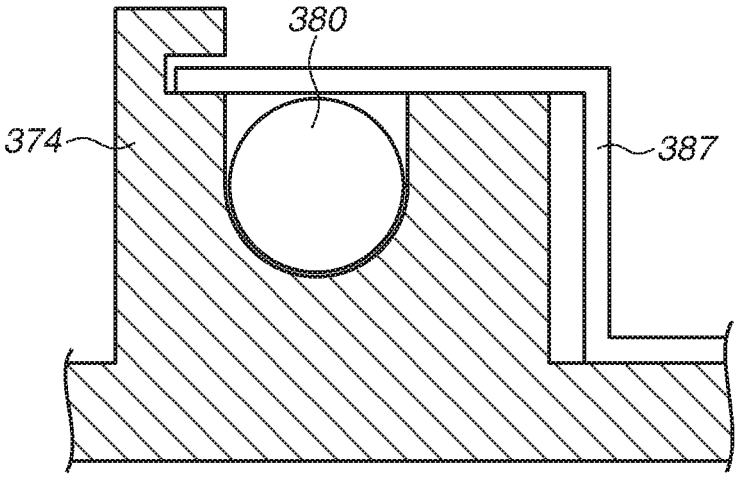

FIG. 10B illustrates a third comparative example. In the third comparative example, the rotation shaft of a detection member 380 is inserted into a shaft bearing member 374 of the detection member 380. Then, after inserting the rotation shaft of the detection member 380 into the shaft bearing member 374, the rotation shaft of the detection member 80 is covered by a retaining member 387, and fix the retaining member 387 with a fastening member (not illustrated). Although this configuration is good in assembling efficiency and the detection member 80 does not come off from the shaft bearing member 374, the dedicated retaining member 387 is required, and therefore the cost increases.

Compared with the third comparative example, the present exemplary embodiment can provide a low-cost apparatus.

In addition, the present exemplary embodiment is applicable to the supporting method of a detection member that performs a reciprocating rotation operation, and among others, operating noise during rotation can be reduced. Therefore, it is useful for an apparatus in which the detection member is disposed at a position near the outside thereof such as near an outer casing.

As an example of the image forming unit for forming an image on a sheet, an electrophotographic method image forming unit is used. However, the present exemplary embodiment is applicable to an image forming apparatus including an ink-jet method image forming unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-010363, filed Jan. 22, 2015, which is hereby incorporated by reference herein in its entirety.

What is claimed is:

1. A sheet conveyance apparatus comprising:

a conveyance unit configured to convey a sheet;

a rotation member configured to rotate by being pushed by a sheet conveyed by the conveyance unit;

a detecting unit configured to detect a rotation of the rotation member; and an attached unit on which the rotation member is rotatably attached, the rotation member including:

a shaft portion, and an elastic portion extending in an axial direction of the shaft portion, the attached unit including, a first supporting portion configured to rotatably support the shaft portion, a second supporting portion configured to rotatably support the shaft portion, and a regulation portion configured to regulate a movement of the rotation member attached on the attached unit in the axial direction of the shaft portion by contacting an end of the elastic portion in the axial direction of the shaft portion, wherein a cross-sectional area of the elastic portion in a plane perpendicular to the axial direction is smaller than a cross-sectional area of a supported portion of the shaft portion, which is supported by the first supporting portion, in the plane perpendicular to the axial direction, the elastic portion is arranged inside of an outline of the supported portion of the shaft portion in a view from the axial direction.

2. The sheet conveyance apparatus according to claim 1, wherein the regulation portion extends in a direction intersecting with the axial direction of the shaft portion, and is a regulation wall including a regulation surface contacting the end of the elastic portion.

3. The sheet conveyance apparatus according to claim 2, wherein a taper portion is provided at an end portion of the regulation wall, inclining with respect to the regulation surface.

4. The sheet conveyance apparatus according to claim 2, wherein the regulation wall is provided with a protruding portion protruding therefrom to prevent the elastic portion from moving in a direction perpendicular to the rotation shaft.

5. The sheet conveyance apparatus according to claim 1, wherein the second supporting portion supports an end portion of the shaft portion.

6. The sheet conveyance apparatus according to claim 1, further comprising a second regulation portion configured to regulate the rotation member from moving in a direction toward the second supporting portion from the first supporting portion by contacting the rotation member.

7. The sheet conveyance apparatus according to claim 6, wherein a second portion of the shaft portion supported by the second supporting portion is smaller in diameter than the supported portion of the shaft portion supported by the first supporting portion, and wherein the second regulation portion regulates the rotation member from moving by contacting a boundary portion between the supported portion and the second portion.

8. The sheet conveyance apparatus according to claim 6, wherein the rotation member is provided with a flange portion between the supported portion of the shaft portion supported by the first supporting portion and a second portion of the shaft portion supported by the second supporting portion, and wherein the second regulation portion regulates the rotation member from moving by contacting the flange portion.

9. The sheet conveyance apparatus according to claim 1, wherein the first supporting portion includes a first opening portion into which the shaft portion is inserted, and the supported portion is supported by at least an arc portion of an inner periphery of the first opening portion, and wherein the second supporting portion includes a second opening portion into which an end portion as a second portion of the shaft portion is inserted, and the second portion is supported by at least an arc portion of an inner periphery of the second opening portion.

10. The sheet conveyance apparatus according to claim 1, wherein the first supporting portion is a first wall portion including a first opening portion into which the shaft portion is inserted, wherein the second supporting portion is a second wall portion including a second opening portion into which an end portion as a second portion of the shaft portion is inserted, and wherein the elastic portion is formed to be flexible so that the end portion of the shaft portion as the second portion can be inserted into the second opening portion in a state where the shaft portion is inserted in the first opening portion.

11. The sheet conveyance apparatus according to claim 1, wherein the elastic portion is smaller in diameter than the supported portion of the shaft portion.

12. The sheet conveyance apparatus according to claim 1, wherein the regulation portion regulates the movement of the rotation member in a first direction along the axial direction by contacting the end of the elastic portion in the first direction.

13. An image forming apparatus comprising:

the sheet conveyance apparatus according to claim 1; and an image forming unit configured to form an image on the sheet conveyed by the sheet conveyance apparatus.

14. The sheet conveyance apparatus according to claim 1, wherein the shaft portion and the elastic portion consist of one piece.

15. The sheet conveyance apparatus according to claim 1, further comprising a spring configured to bias the rotation member toward a predetermined position, wherein the rotation member rotates from the predetermined position against a biasing force of the spring by being pushed by the sheet.

16. The sheet conveyance apparatus according to claim 1, wherein the elastic portion has a first end connected to the shaft portion and a second end opposite to the first end in the axial direction, and wherein a moving amount of a second end side in an orthogonal direction is larger than a moving amount of a first end side in a state that force is applied on the elastic portion in the orthogonal direction.

17. The sheet conveyance apparatus according to claim 1, wherein a length of the elastic portion in the axial direction is longer than half the distance between the first supporting portion and the regulation portion in the axial direction.

18. The sheet conveyance apparatus according to claim 1, wherein the rotation member further includes a detected portion detected by the detecting unit, wherein the detected portion is positioned between the first supporting portion and the second supporting portion in the axial direction, and wherein the elastic portion is positioned between the first supporting portion and the regulation portion in the axial direction.

19. A sheet conveyance apparatus, comprising:

a conveyance unit configured to convey a sheet;

a rotation member including a rotation shaft and configured to rotate by being pushed by a sheet conveyed by the conveyance unit;

a detecting unit configured to detect a rotation of the rotation member; and an attached unit on which the rotation member is rotatably attached, the attached unit comprising:

a first supporting portion configured to rotatably support the rotation shaft, a second supporting portion configured to rotatably support the rotation shaft, a first regulation portion configured to regulate a movement of the rotation member supported by the first supporting portion and the second supporting portion in a first direction toward the first supporting portion from the second supporting portion by contacting an end of an elastic portion of the rotation shaft in the first direction, and a second regulation portion configured to regulate a movement of the rotation member in a second direction opposite to the first direction, wherein the rotation shaft includes, a first portion being in contact with the first supporting portion to be supported by the first supporting portion, a second portion being in contact with the second supporting portion to be supported by the second supporting portion, and the elastic portion extending in an axial direction of the rotation shaft, wherein the first supporting portion is located at a position at least the length of the elastic portion from the first regulating portion in the axial direction, and wherein a cross-sectional area of the elastic portion in a plane perpendicular to the axial direction is smaller than a cross-sectional area of the first portion in the plane perpendicular to the axial direction, and the length of the elastic portion in the axial direction is at least half the distance between the first supporting portion and the first regulation portion in the axial direction, wherein the rotation member is configured such that the second portion, the first portion, and the elastic portion are arranged in this order in the first direction, and wherein the attached unit is configured such that the second regulation portion, the first supporting portion, and a part of the first regulating portion to be contacted with the end of the elastic portion are arranged in this order in the first direction.

20. The sheet conveyance apparatus according to claim 19, wherein the elastic portion is smaller in diameter than the first portion of the rotation shaft.

21. The sheet conveyance apparatus according to claim 19, wherein the first regulation portion extends in a direction intersecting with the axial direction of the rotation shaft, and is a regulation wall including a regulation surface contacting an end of the elastic portion.

22. The sheet conveyance apparatus according to claim 19, wherein the second portion is smaller in diameter than the first portion, and wherein the second regulation portion regulates the rotation member from moving by contacting a boundary portion between the first portion and the second portion.

23. The sheet conveyance apparatus according to claim 19, wherein the rotation shaft is provided with a flange portion between the first portion and the second portion, and wherein the second regulation portion regulates the rotation member from moving by contacting the flange portion.

24. The sheet conveyance apparatus according to claim 19, wherein the elastic portion is formed to be flexible so that an end portion of the rotation shaft as the second portion can be engaged with the second supporting portion in a state where the rotation shaft is inserted in an opening of the first supporting portion.

25. The sheet conveyance apparatus according to claim 19, wherein the elastic portion includes a portion that is smaller in diameter than the first portion of the rotation shaft.

26. The sheet conveyance apparatus according to claim 19, wherein the rotation member further includes a detected portion detected by the detecting unit, wherein the detected portion is positioned between the first supporting portion and the second supporting portion in the axial direction, and wherein the elastic portion is positioned between the first supporting portion and the first regulation portion in the axial direction.

* * * * *